US009145665B2

(12) United States Patent
Bors et al.

(10) Patent No.: US 9,145,665 B2
(45) Date of Patent: Sep. 29, 2015

(54) ADJUSTABLE LOCKING SPOUT SHANK

(75) Inventors: Mark S. Bors, Grafton, OH (US); Michael L. Malek, North Olmsted, OH (US); William E. Patton, Columbia Station, OH (US)

(73) Assignee: MOEN INCORPORATED, North Olmsted, OH (US)

( * ) Notice: Subject to any disclaimer, the term of this patent is extended or adjusted under 35 U.S.C. 154(b) by 2272 days.

(21) Appl. No.: 12/100,497

(22) Filed: Apr. 10, 2008

(65) Prior Publication Data

US 2009/0255588 A1 Oct. 15, 2009

(51) Int. Cl.
*E03C 1/042* (2006.01)
*E03C 1/04* (2006.01)

(52) U.S. Cl.
CPC ..... *E03C 1/0401* (2013.01); *E03C 1/04* (2013.01); *Y10T 137/0402* (2015.04); *Y10T 137/698* (2015.04)

(58) Field of Classification Search
CPC ..... E03C 1/0401
USPC ..... 4/695, 696; 137/15.01
See application file for complete search history.

(56) References Cited

U.S. PATENT DOCUMENTS

| | | | | |
|---|---|---|---|---|
| 2,575,685 | A | 11/1951 | Shugart et al. | |
| 3,029,831 | A | 4/1962 | Leete | |
| 3,105,707 | A | 10/1963 | Jacobson | |
| 3,188,120 | A | 6/1965 | Peterson | |
| 3,958,819 | A | 5/1976 | Tifft | |
| 4,007,877 | A | 2/1977 | Jackson et al. | |
| 4,007,878 | A | 2/1977 | Anderson | |
| 4,083,410 | A | 4/1978 | Anderson | |
| 4,457,342 | A | 7/1984 | Moen | |
| 4,463,460 | A | 8/1984 | Arnold et al. | |
| 4,662,389 | A | 5/1987 | Igbal | |
| 4,852,192 | A | 8/1989 | Viegener | |
| 5,135,022 | A * | 8/1992 | Kovey et al. | 137/360 |
| 5,381,830 | A * | 1/1995 | Niemann et al. | 137/801 |
| 5,697,393 | A | 12/1997 | Mirlisena, Sr. | |
| 6,464,265 | B1 | 10/2002 | Mikol | |
| 6,668,393 | B1 | 12/2003 | Mascari et al. | |
| 7,273,070 | B2 * | 9/2007 | Lin | 137/801 |
| 7,896,025 | B2 * | 3/2011 | Hanson | 137/454.6 |
| 2006/0237072 | A1 | 10/2006 | Lee | |

* cited by examiner

*Primary Examiner* — Lori Baker
(74) *Attorney, Agent, or Firm* — Calfee, Halter & Griswold LLP

(57) ABSTRACT

A spout shank allows a spout to be mounted on one side of a mounting surface and then connected to a water supply source disposed on the other side of the mounting surface. The spout shank has a length that is adjustable over a range of lengths to accommodate mounting surfaces with different thicknesses.

18 Claims, 19 Drawing Sheets

SECTION A-A

SECTION A-A

SECTION A-A

SECTION A-A

SECTION A-A

ADJUSTABLE LOCKING SPOUT SHANK

FIELD

The invention relates generally to the field of plumbing fixtures and, more particularly, to an adjustable locking spout shank for use with plumbing fixtures.

BACKGROUND

Many plumbing fixtures include a spout that is mounted on a deck or wall, wherein the spout interfaces with a tube or shank extending through the deck or wall for connection to water supply pipes on the other side of the deck or the wall. A thickness through which the tube or shank must extend to reach the water supply pipes and still provide a suitable interface or mount for the spout often varies among different decks and walls. As a result, a conventional tube or shank for mounting a spout must be cut down to a required length once the installation thickness is determined. Cutting the tube or shank during installation of a plumbing fixture, however, gives rise to numerous drawbacks. For example, cutting the tube or shank is a relatively time consuming process which may need to be repeated for each plumbing fixture being installed. As another example, cutting the tube or shank requires that an installer carry a tool suitable for cutting the tube or shank. As yet another example, cutting the tube or shank is generally an irreversible process, which can render the tube or shank unusable for a given installation thickness.

Consequently, there is a need in the art for a spout tube or shank that can be quickly sized to a needed length without cutting the tube or shank.

SUMMARY

In view of the above, it is an exemplary aspect to provide an adjustable locking spout shank.

It is another exemplary aspect to provide a spout shank that can be readily extended from and retracted in a fixed body to accommodate a range of installation thicknesses.

It is yet another exemplary aspect to provide a spout shank in which an installation length of the spout shank can be adjusted without cutting the spout shank.

It is still another exemplary aspect to provide a spout shank in which the spout shank can be locked at a desired installation length.

It is another exemplary aspect to provide an adjustable locking spout shank on which a spout can be securely mounted.

Numerous other advantages and features will become readily apparent from the following detailed description of exemplary embodiments, from the claims and from the accompanying drawings.

BRIEF DESCRIPTION OF THE DRAWINGS

The above aspects and additional aspects, features and advantages will become readily apparent by describing in detail exemplary embodiments thereof with reference to the attached drawings, wherein like reference numerals denote like elements, and:

FIG. 1A is an exploded perspective view of the adjustable locking spout shank assembly. FIG. 1B is an assembled perspective view of the adjustable locking spout shank assembly. FIG. 1C is a cross-sectional view of the spout shank assembly of FIG. 1B, along line A-A.

FIG. 2A is a perspective view of the spout shank. FIG. 2B is a side elevational view of the spout shank. FIG. 2C is a bottom plan view of the spout shank. FIG. 2D is a cross-sectional view of the spout shank shown in FIG. 2C, along line A-A.

FIG. 3A is a perspective view of the nipple body. FIG. 3B is an exploded perspective (assembly) view of the nipple body. FIG. 3C is a top plan view of the nipple body. FIG. 3D is a cross-sectional view of the nipple body shown in FIG. 3C, along line A-A.

FIG. 4A is a perspective view of the wedge nut. FIG. 4B is a side elevational view of the wedge nut. FIG. 4C is a bottom plan view of the wedge nut. FIG. 4D is a cross-sectional view of the wedge nut shown in FIG. 4C, along line A-A.

FIG. 5A is a perspective view of the clip. FIG. 5B is a top plan view of the clip. FIG. 5C is a side elevational view of the clip. FIG. 5D is a cross-sectional view of the clip shown in FIG. 5C, along line A-A.

DETAILED DESCRIPTION

Figure 1A:
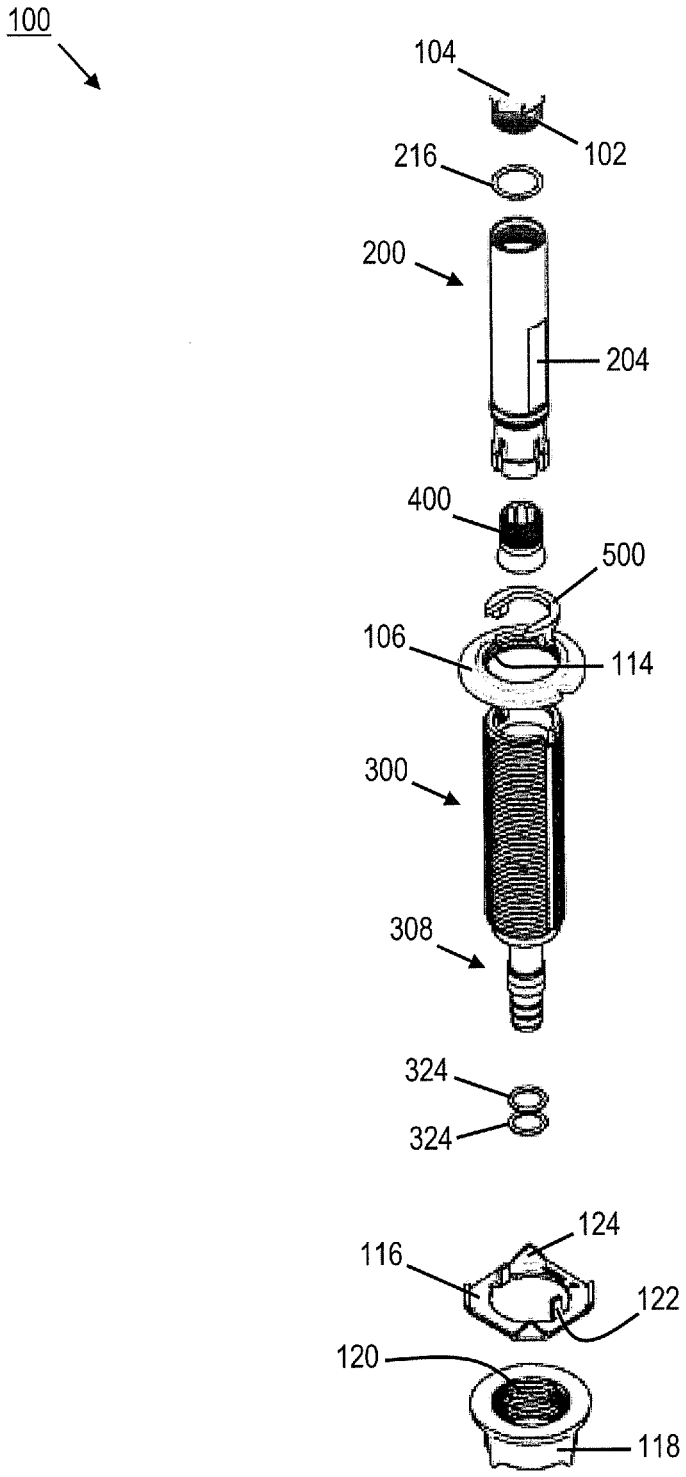
FIGS. 1A-1C show an adjustable locking spout shank assembly, according to an exemplary embodiment.

While the general inventive concept is susceptible of embodiment in many different forms, there are shown in the drawings and will be described herein in detail specific embodiments thereof with the understanding that the present disclosure is to be considered as an exemplification of the principles of the general inventive concept. Accordingly, the general inventive concept is not intended to be limited to the specific embodiments illustrated herein.

An adjustable locking spout shank assembly 100 (see FIGS. 1A-1C), according to an exemplary embodiment, will now be described. The adjustable locking spout shank assembly 100 includes a spout shank 200 (see FIGS. 2A-2D), a nipple body 300 (see FIGS. 3A-3D), a wedge nut 400 (see FIGS. 4A-4D) and a clip 500 (see FIGS. 5A-5D).

As shown in FIGS. 2A-2D, the spout shank 200 is a generally tubular body having an inner cavity 202 through which a fluid (e.g., water) can flow. The spout shank 200 includes at least one axially extending flat portion 204 formed on an outer surface of the spout shank 200. In one exemplary embodiment, two flat portions 204 are formed on opposite sides of the spout shank 200 (see FIG. 2B).

The spout shank 200 also includes at least one flange 206 formed at an end of the spout shank 200. A gap 208 is formed on each side of the at least one flange 206 to allow the flange 206 to flex. In one exemplary embodiment, four flanges 206 are equally spaced around the end of the spout shank 200 with each adjacent pair of the flanges 206 being separated by a gap 208 (see FIG. 2C). Each flange 206 includes a first portion 210 having a first thickness and a second portion 212 having a second thickness, wherein the first thickness is less than the second thickness and/or the rest of the spout shank 200. Because the first portion 210 of the flanges 206 has a decreased thickness relative to the second portion 212 of the flanges 206 and/or the rest of the spout shank 200, the flanges 206 are more readily able to bend at the first portion 210 when subjected to a force.

The spout shank 200 also includes a circumferential groove 214 formed on the outer surface of the spout shank 200. The circumferential groove 214 is located between the flat portions 204 and the flanges 206 (see FIG. 2B). The circumferential groove 214 is operable to receive an O-ring 216, as described below.

Figure 2A:
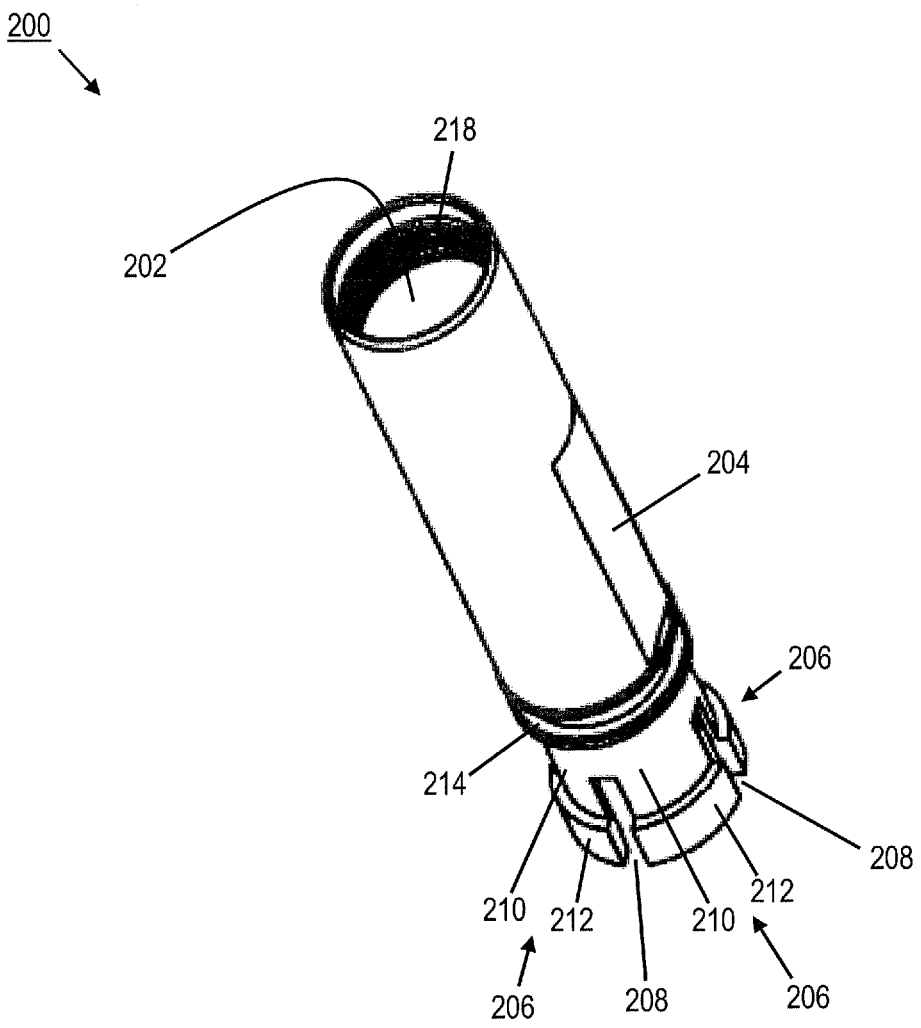
FIGS. 2A-2D show a spout shank, according to an exemplary embodiment, for use in the adjustable locking spout shank assembly of FIGS. 1A-1C.
Figure 2B:
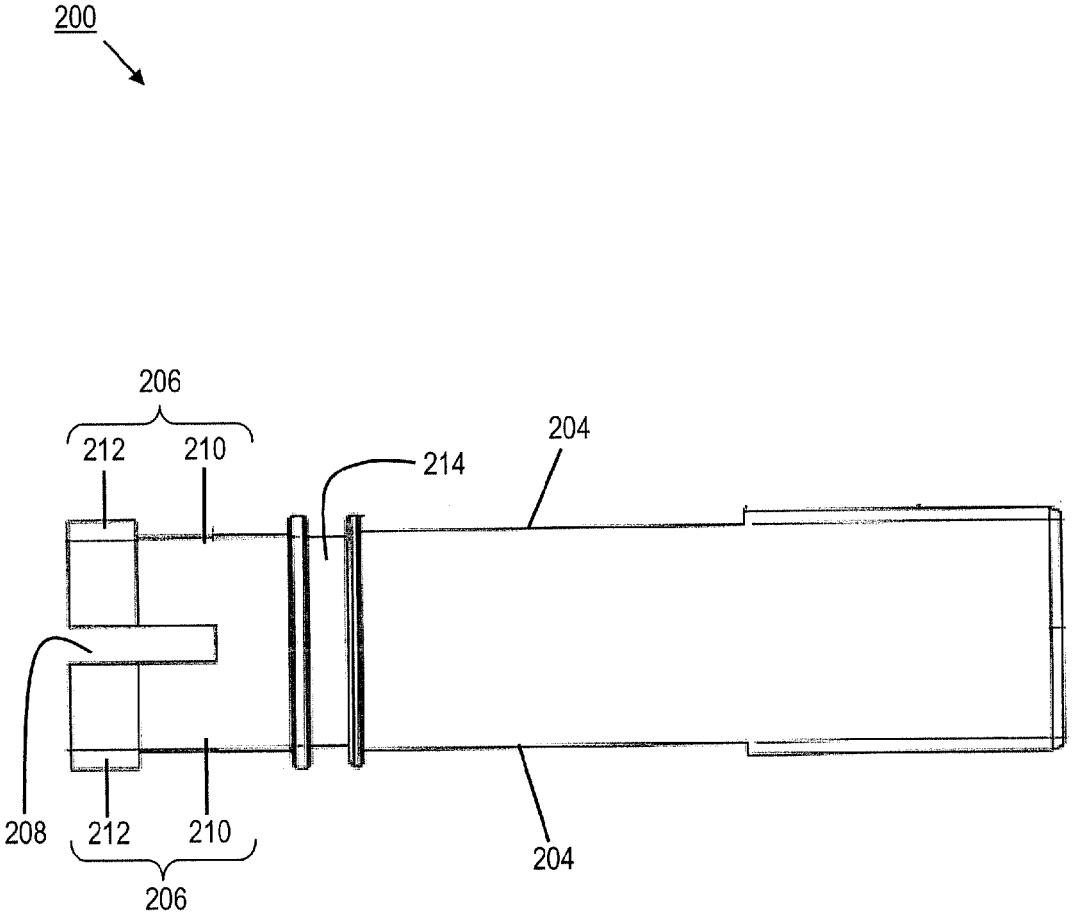
Figure 2C:
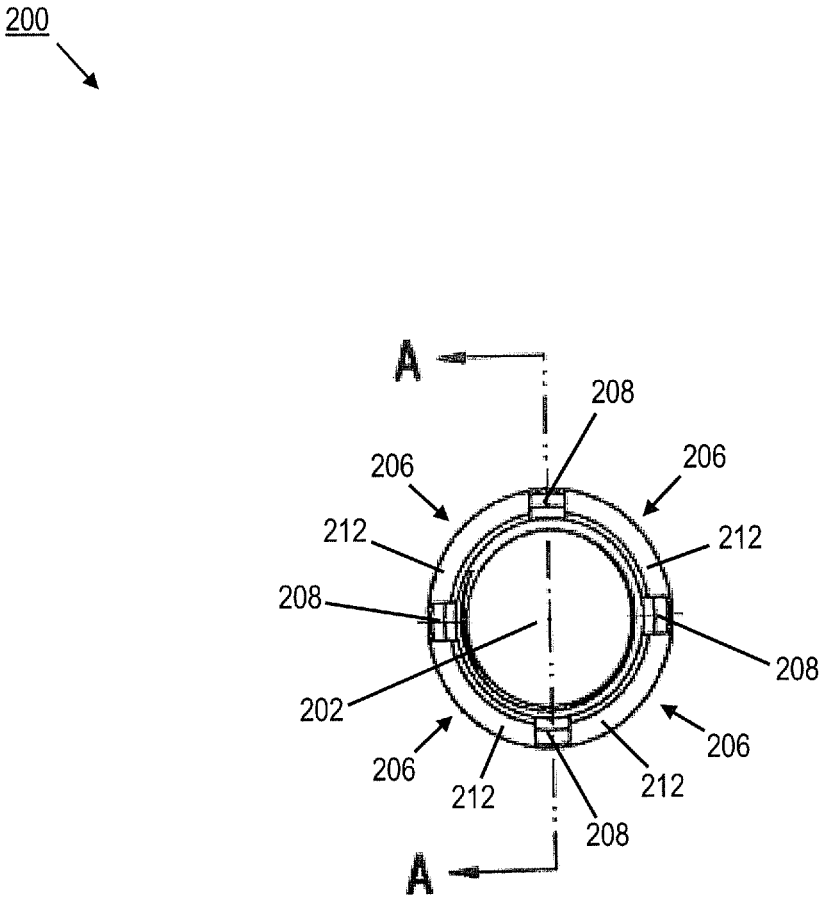
Figure 2D:
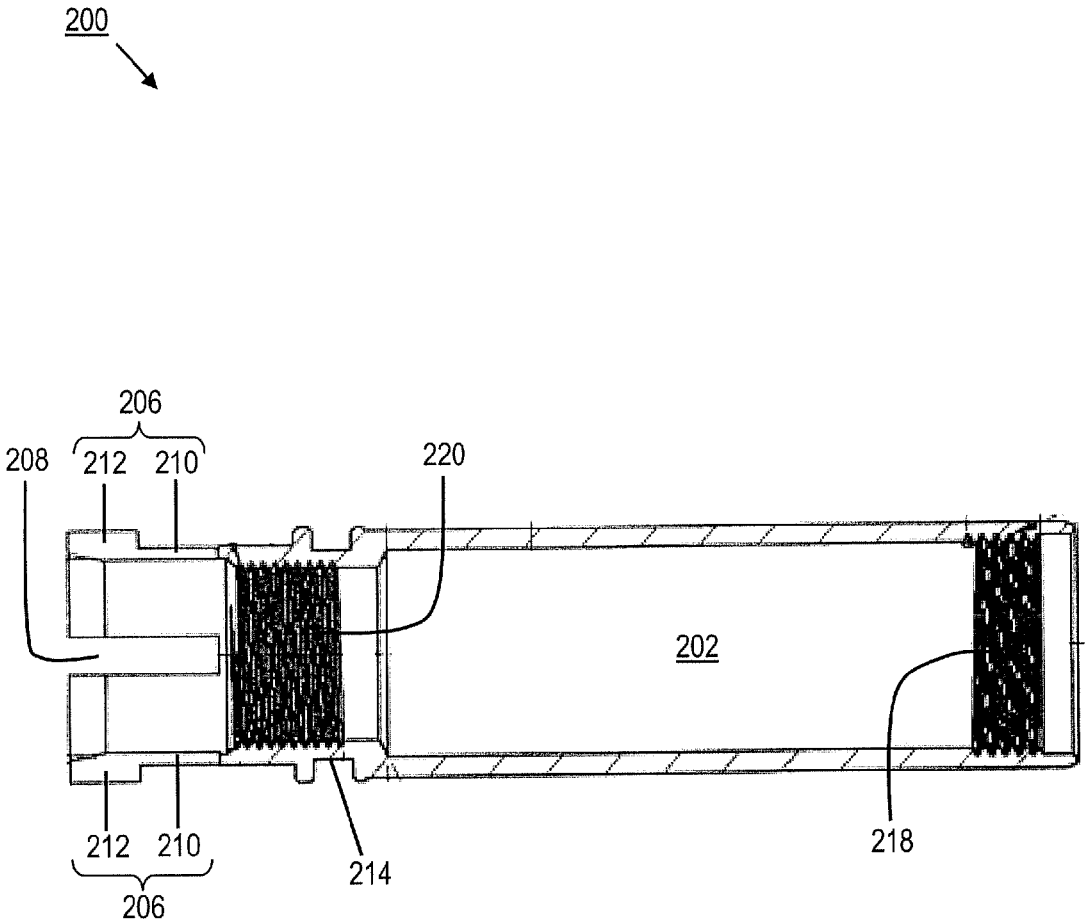

As shown in FIG. 2D, a first threaded portion 218 and a second threaded portion 220 are formed around a circumference of an inner surface of the spout shank 200. The first threaded portion 218 is located near an end of the spout shank 200 opposite the end of the spout shank 200 where the flanges 206 are formed. The second threaded portion 220 is located immediately adjacent to the flanges 206 of the spout shank 200. Both the first threaded portion 218 and the second threaded portion 220 extend into the inner cavity 202 of the spout shank 200.

The first threaded portion 218 interfaces with threads 102 formed on a test plug 104. The test plug 104 seals the end of the spout shank 200 so that the adjustable locking spout shank assembly 100 can be tested during installation, for example, to insure that the adjustable locking spout shank assembly 100 does not leak. The second threaded portion 220 interfaces with threads 408 formed on the wedge nut 400, as described below.

As shown in FIGS. 3A-3D, the nipple body 300 is a generally tubular body having an inner cavity 302 through which a fluid (e.g., water) can flow. A circumference of an inner surface of the nipple body 300 is larger than a circumference of the outer surface of the spout shank 200. As a result, at least a portion of the spout shank 200 can fit in the inner cavity 302 of the nipple body 300 to form a telescopic assembly, as described below. The nipple body 300 is formed from an outer sleeve 304, an inner sleeve 306 and a connector 308 (see FIG. 3B).

Figure 3A:
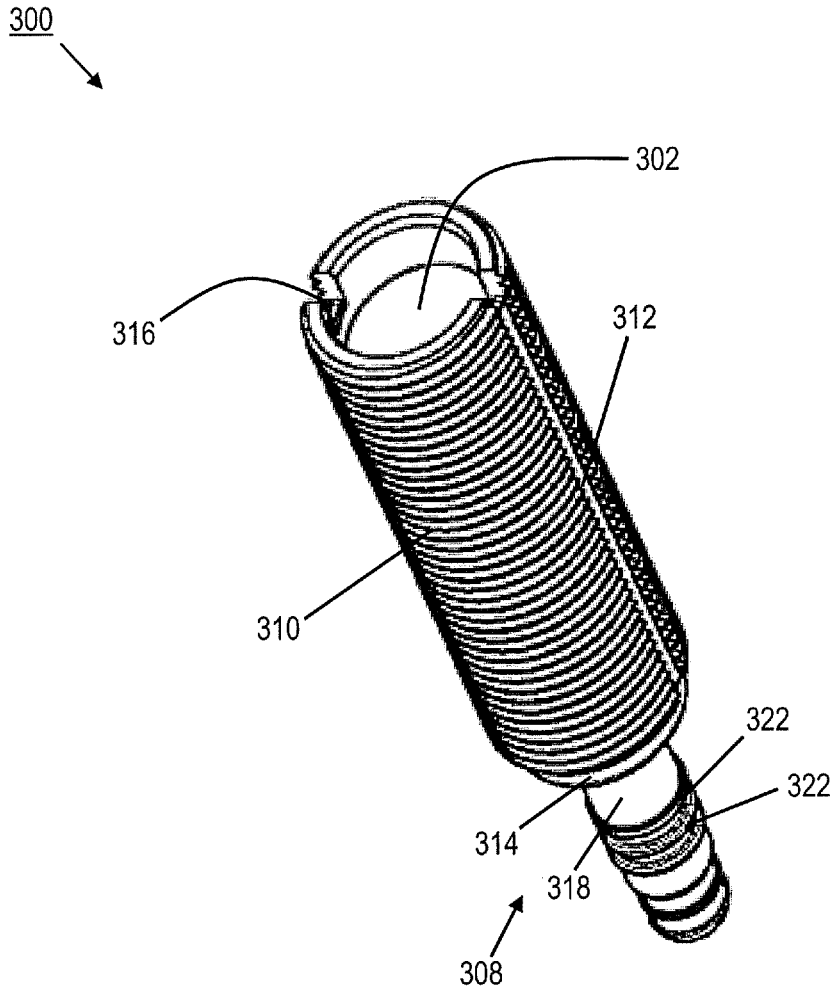
FIGS. 3A-3D show a nipple body, according to an exemplary embodiment, for use in the adjustable locking spout shank assembly of FIGS. 1A-1C.
Figure 3B:
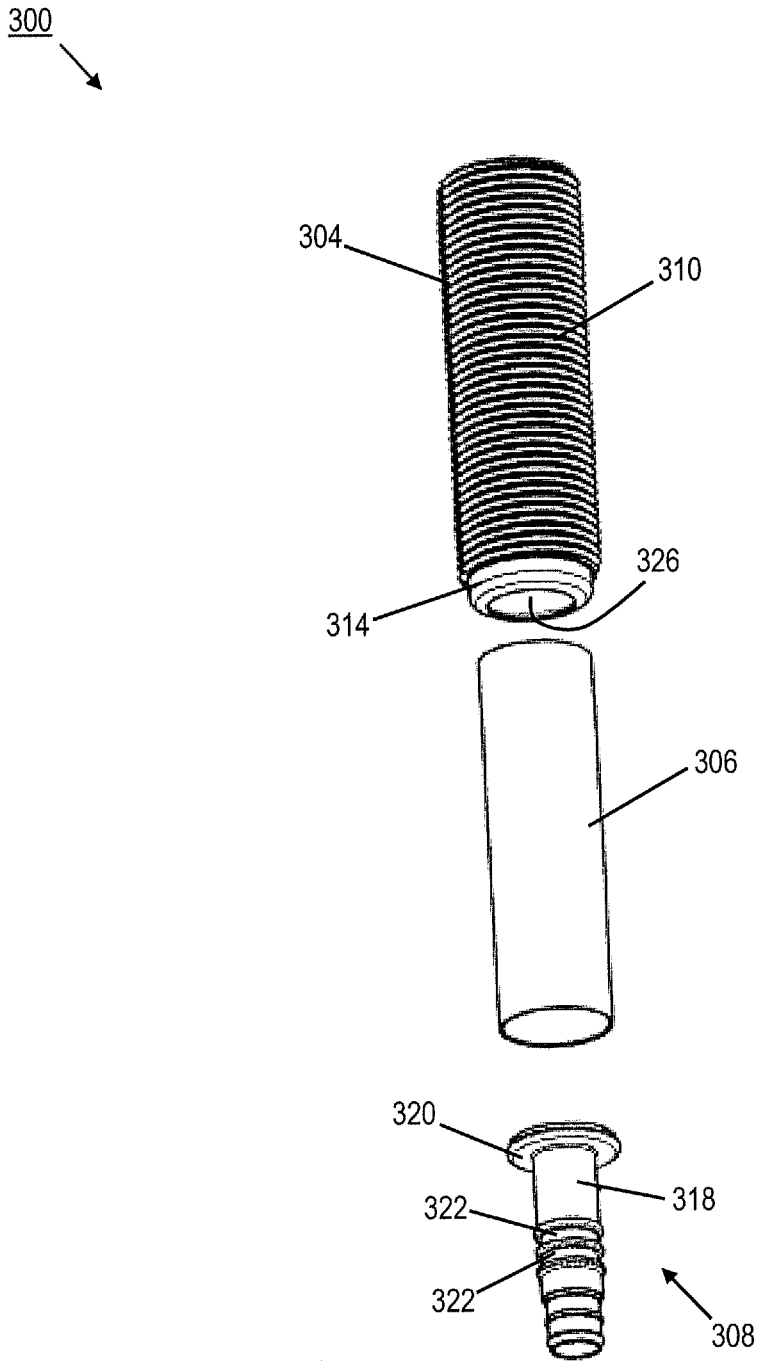
Figure 3C:
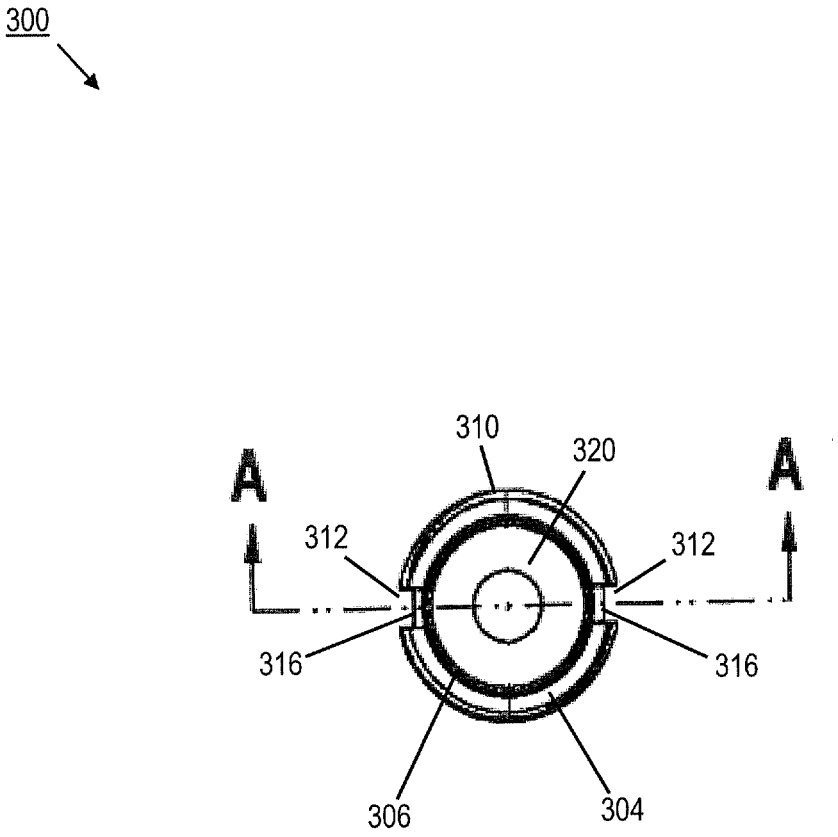
Figure 3D:
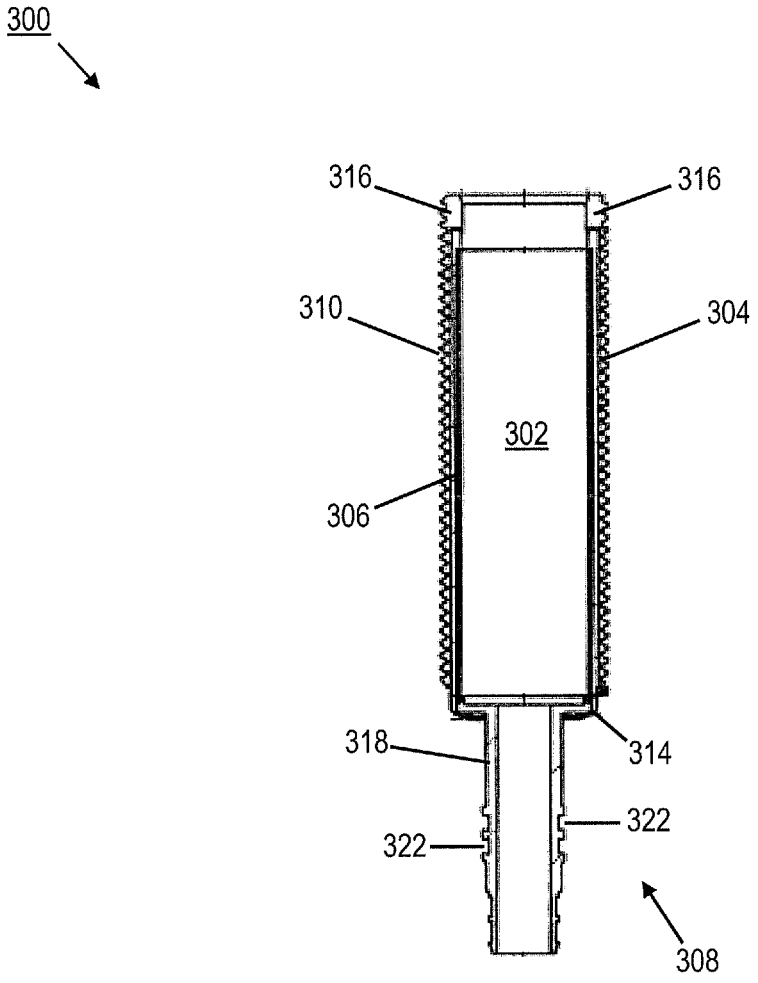
Figure 4A:
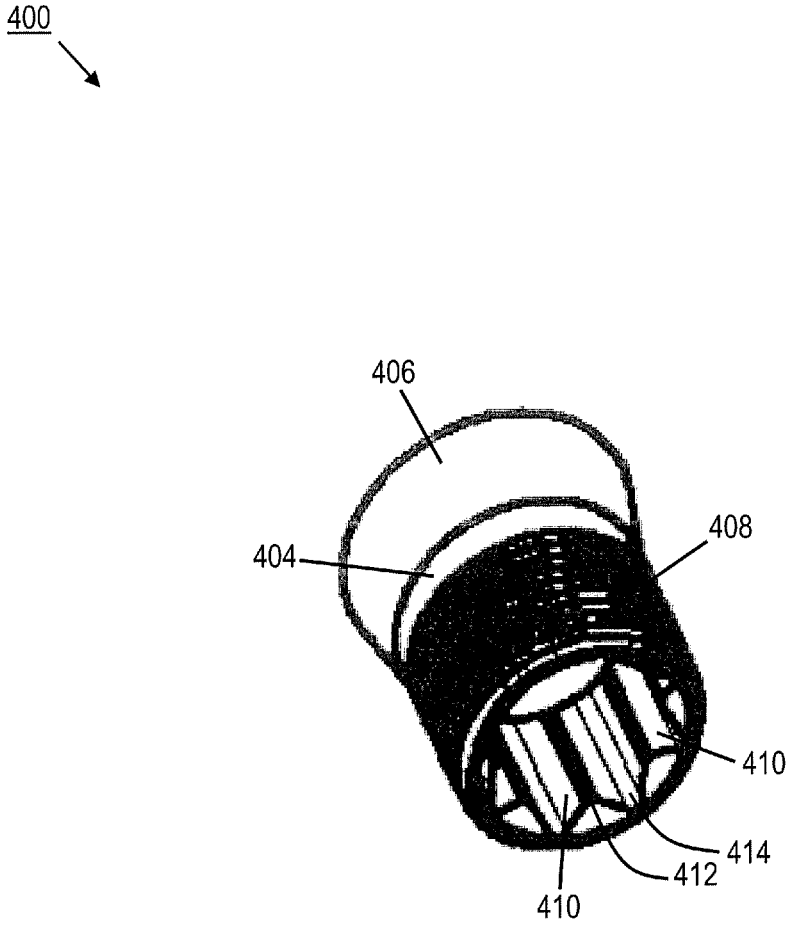
FIGS. 4A-4D show a wedge nut, according to an exemplary embodiment, for use in the adjustable locking spout shank assembly of FIGS. 1A-1C.
Figure 4B:
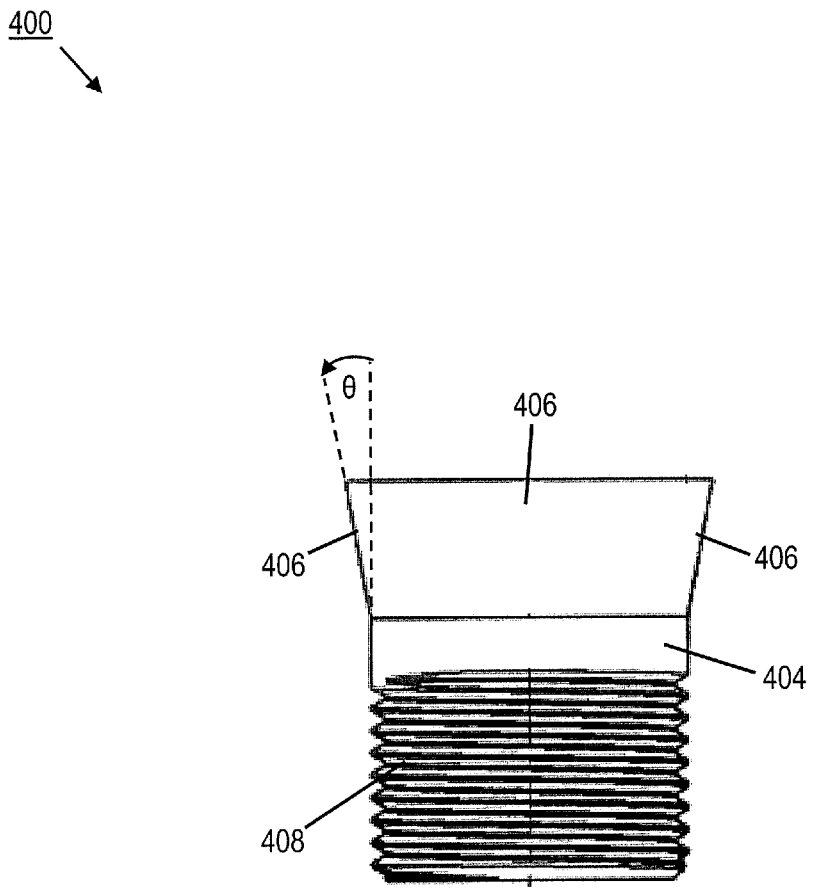
Figure 4C:
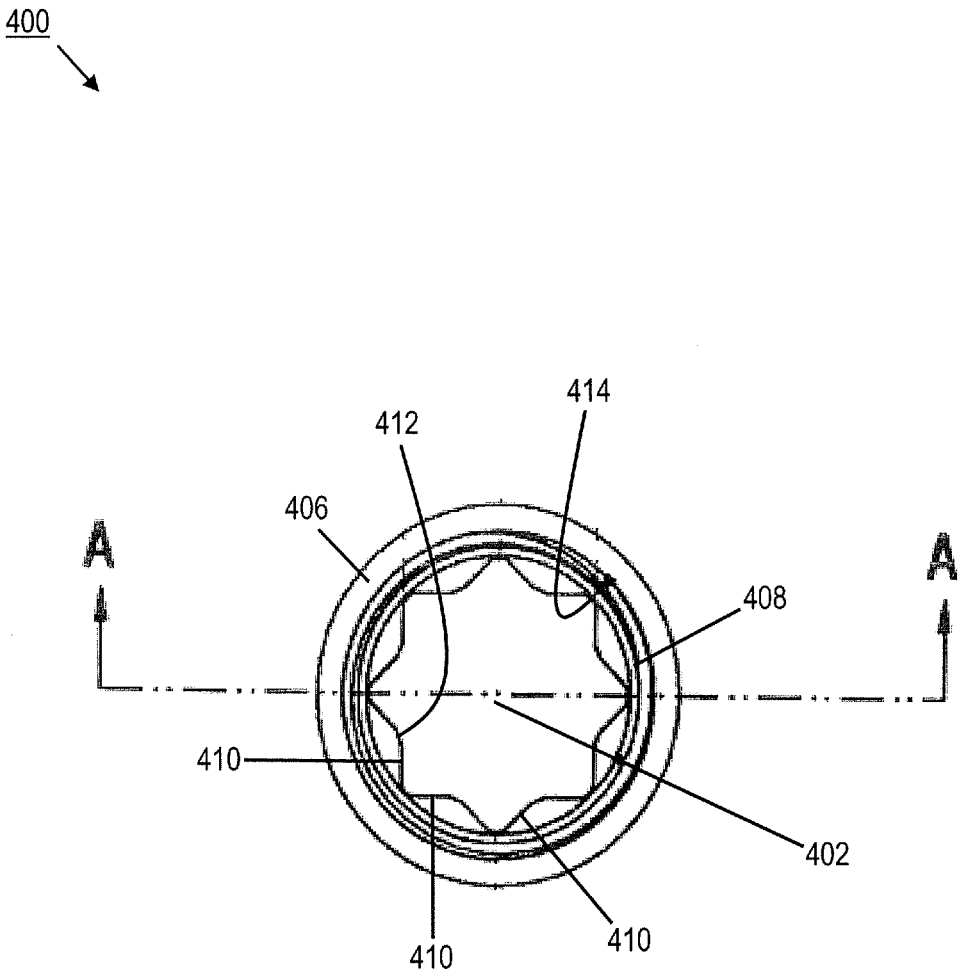
Figure 4D:
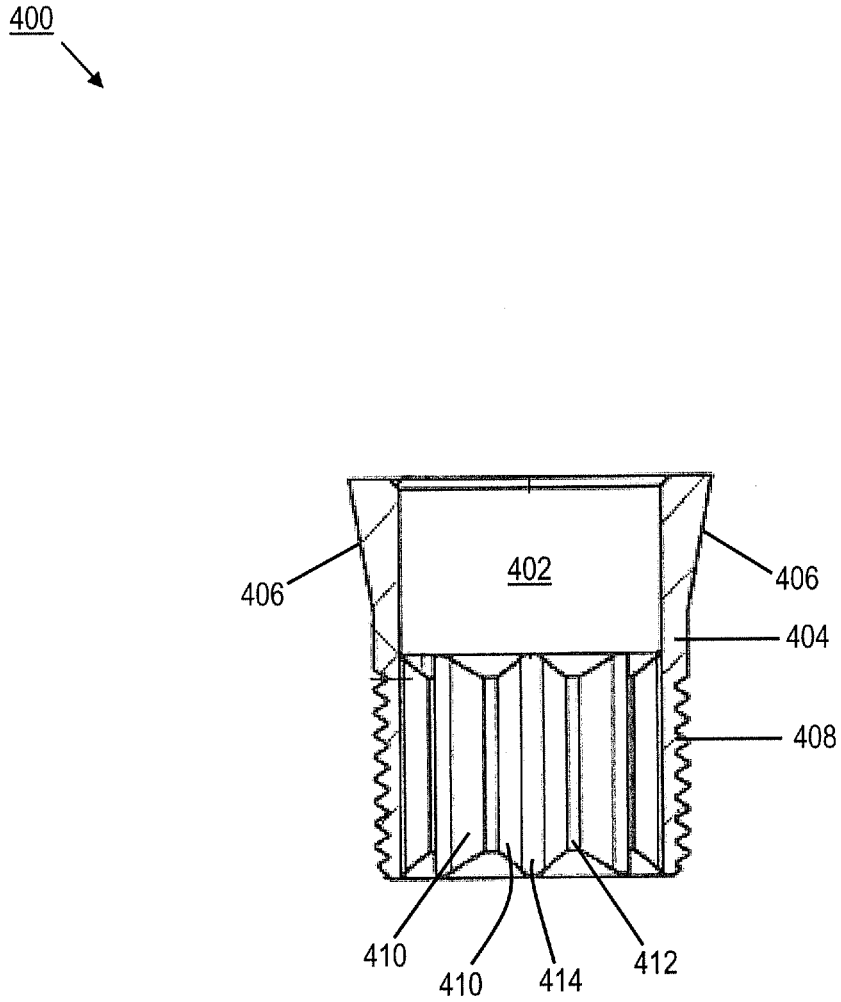
Figure 5A:
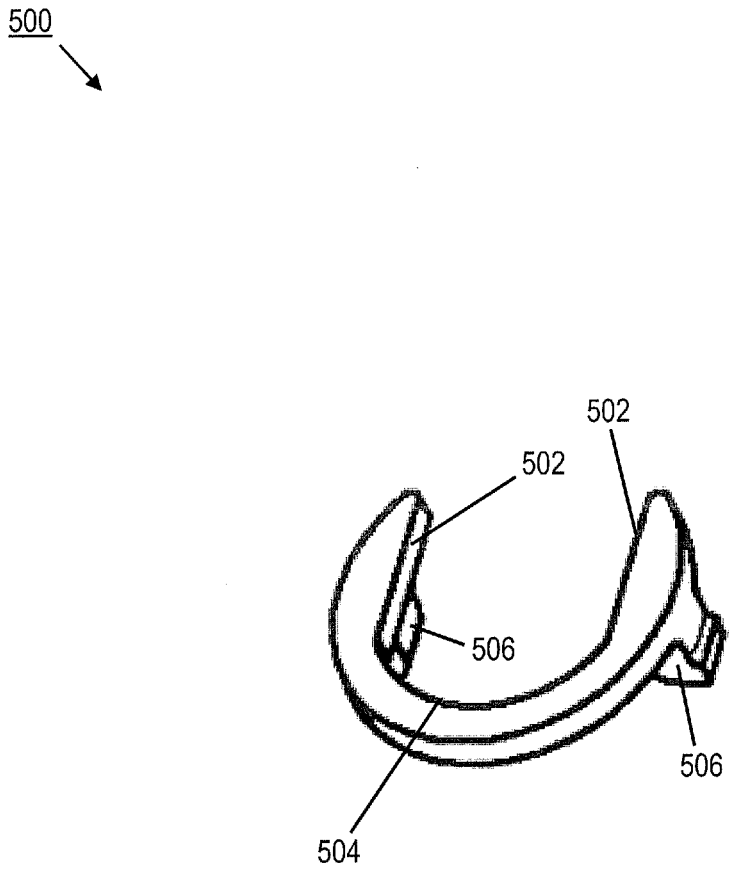
FIGS. 5A-5D show a clip, according to an exemplary embodiment, for use in the adjustable locking spout shank assembly of FIGS. 1A-1C.
Figure 5B:
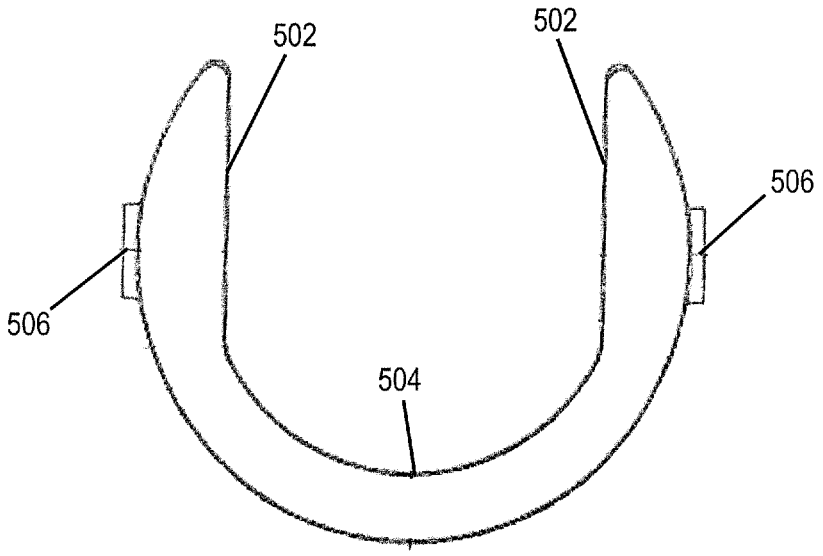
Figure 5C:
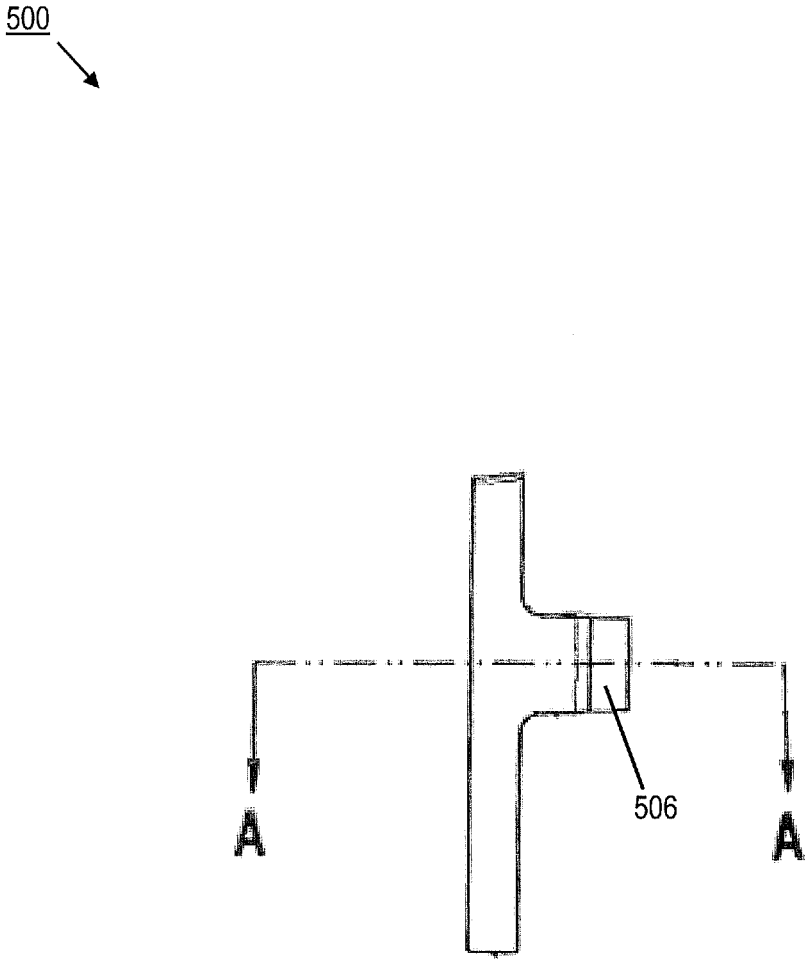
Figure 5D:
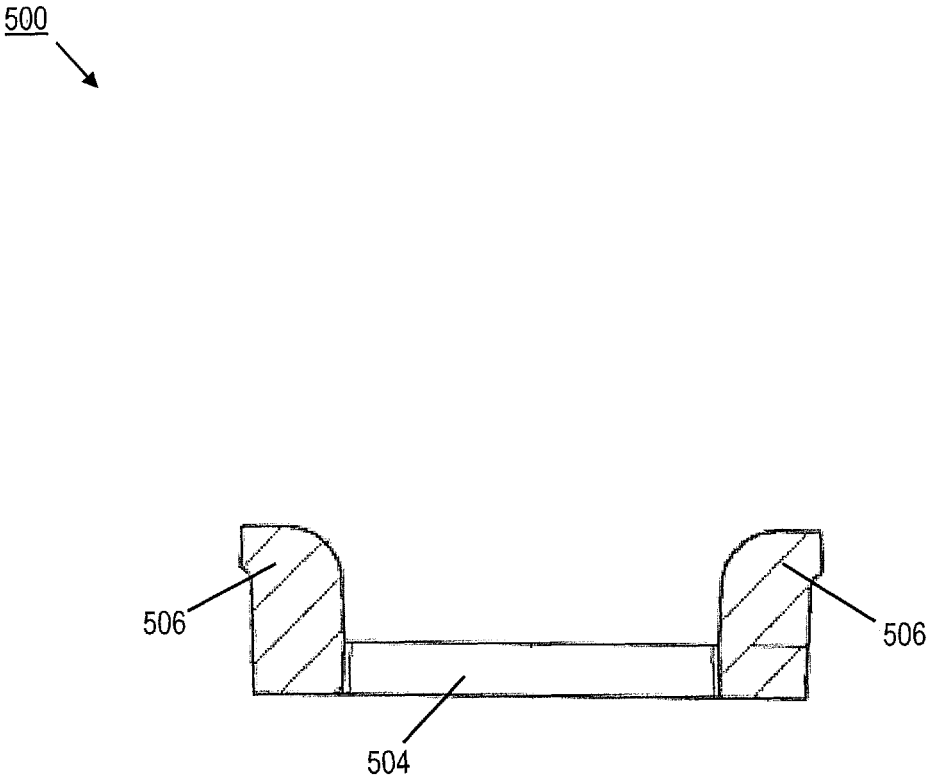

Threads 310 are formed around a circumference of the outer sleeve 304 along a substantial length of the outer sleeve 304 (see FIGS. 3A, 3B and 3D). At least one break is provided in the threads 310 to form an axial groove 312 along a substantial length of the outer sleeve 304. In one exemplary embodiment, a pair of axial grooves 312 are located on opposite sides of the outer sleeve 304 (see FIG. 3C). The outer sleeve 304 includes a curved lip portion 314 at one end. The threads 310 are not formed on the lip portion 314 of the outer sleeve 304. The outer sleeve 304 also includes at least one notch 316 formed at an end opposite the end with the lip portion 314. In one exemplary embodiment, a pair of equally sized notches 316 are disposed directly across from one another (see FIGS. 3A, 3C and 3D). In one exemplary embodiment, the pair of axial grooves 312 are aligned with the pair of notches 316 (see FIGS. 3A and 3C).

The connector 308 includes a generally tubular nipple 318 with a generally circular ledge 320 formed at one end. The tubular nipple 318 includes at least one circumferential groove 322. In one exemplary embodiment, a pair of circumferential grooves 322 are located adjacent to one another on the tubular nipple 318 (see FIGS. 3B and 3D). The circumferential grooves 322 are operable to receive O-rings 324, as described below.

In one exemplary embodiment, the connector 308 is a multi-attachment fitting operable to interface with a hose, pipe or other conduit using at least two different connection methods. In one exemplary embodiment, the connector 308 can interface with a PEX (crosslinked polyethylene) hose by using a PEX connection method. The PEX connection method includes using a crimp ring that is crimped around a portion of the PEX hose in which the connector 308 is inserted, thereby securing the PEX hose to the connector 308. In one exemplary embodiment, the connector 308 can interface with a hose by using a quick-connect method. The quick-connect method includes using a quick-connect hose assembly. The quick-connect hose assembly has a quick-connect connector for interfacing with the connector 308 without using any tools. For example, the quick-connect hose assembly can snap onto the connector 308, thereby securing the quick-connect hose assembly to the connector 308.

In one exemplary embodiment, the nipple body 300 is formed by connecting (e.g., brazing) the circular ledge 320 of the connector 308 to the inner sleeve 306. The combined inner sleeve 306 and connector 308 are then inserted into the outer sleeve 304 through the end opposite the end with the lip portion 314. The tubular nipple 318 of the connector 308 fits through an opening 326 in the lip portion 314, while the circular ledge 320 of the connector 308 does not fit through the opening 326 in the lip portion 314 (see FIGS. 3B and 3D). Thereafter, the lip portion 314 of the outer sleeve 304 is deformed (e.g., pressed, folded, pinched) to affix the combined inner sleeve 306 and connector 308 in the outer sleeve 304, thereby forming the nipple body 300. One of ordinary skill in the art will appreciate that the nipple body 300 can be formed by joining the outer sleeve 304, the inner sleeve 306 and the connector 308 in various other ways.

As shown in FIGS. 4A-4D, the wedge nut 400 includes a generally tubular body having an inner cavity 402 through which a fluid (e.g., water) can flow. More specifically, the wedge nut 400 includes a cylindrical portion 404 and a sloped portion 406 (see FIGS. 4A, 4B and 4D). The sloped portion 406 has a circumference that increases as its distance from the cylindrical portion 404 increases. In one exemplary embodiment, the sloped portion 406 has a slope of approximately 11 degrees with respect to the cylindrical portion 404, which is represented by the angle θ in FIG. 4B. The wedge nut 400 includes the threads 408 formed on an outer surface of the cylindrical portion 404. The threads 408 are complementary to the second threaded portion 220 of the spout shank 200 so that the wedge nut 400 can be screwed in the spout shank 200. In one exemplary embodiment, the wedge nut 400 is made of brass.

The wedge nut 400 also includes facets 410 formed on an inner surface of the cylindrical portion 404. The facets 410 are formed in an alternating pattern resulting in a series of adjacent peaks 412 and valleys 414 (see FIGS. 4A, 4C and 4D). The peaks 412 extend into the inner cavity 402 of the wedge nut 400. The valleys 414 are flush with the inner surface of the cylindrical portion 404 of the wedge nut 400.

As shown in FIGS. 5A-5D, the clip 500 is a generally C-shaped body having opposing flat sides 502 connected by a curved side 504. At least one tab 506 extends from a lower surface of the clip 500. In one exemplary embodiment, a pair of tabs 506 extend from the lower surface of the clip 500, wherein the tabs 506 are aligned with the flat sides 502 of the clip 500 (see FIGS. 5A and 5B). In one exemplary embodiment, the clip 500 is made of chrome plated zinc.

In view of the above, operation of the adjustable locking spout shank assembly 100, according to an exemplary embodiment, will now be described in the context of mounting a spout (not shown) on a mounting surface (e.g., a tub deck) (not shown).

Initially, when the final thickness of the mounting surface is not yet known, the nipple body 300 can be installed in a pre-mounting surface (not shown). The pre-mounting surface, for example, can be the surface available at a rough-in stage for a plumbing fixture such as a roman tub spout. The nipple body 300 is installed by placing a first mounting nut 106 on an end of the nipple body 300 opposite the end with the connector 308. The first mounting nut 106 is a generally annular body including a generally circular raised portion 108. The first mounting nut 106 can include structure (e.g., a hole 110, a recess 112) for interfacing with the spout being mounted on the mounting surface (see FIG. 1B). Threads 114 are formed around a circumference of a portion of an inner surface of the first mounting nut 106 (see FIG. 1A). The threads 114 are complementary to the threads 310 formed on the outer sleeve 304 of the nipple body 300 so that the first mounting nut 106 can be screwed on the nipple body 300. In one exemplary embodiment, the threads 114 on the first mounting nut 106 are not formed on an inner surface of the circular raised portion 108 of the first mounting nut 106, such that the first mounting nut 106 can only be screwed down on the nipple body 300 until the circular raised portion 108 is reached (see FIG. 1C). Once the first mounting nut 106 is screwed on the nipple body 300, the nipple body 300 is prevented from falling through a hole in the pre-mounting surface through which the nipple body 300 extends.

With the nipple body 300 extending through the hole in the pre-mounting surface, a mounting washer 116 is slid over the end of the nipple body 300 with the connector 308 and up against the pre-mounting surface. Then, a second mounting nut 118 is slid over the end of the nipple body 300 with the connector 308. The second mounting nut 118 is a generally annular body with threads 120 formed around a circumference of at least a portion of an inner surface of the second mounting nut 118 (see FIG. 1A). The threads 120 are complementary to the threads 310 formed on the outer sleeve 304 of the nipple body 300 so that the second mounting nut 118 can be screwed on the nipple body 300. The second mounting nut 118 can have structure (e.g., ribs) formed thereon to facilitate turning of the second mounting nut 118 with a tool (e.g., a wrench).

By screwing the second mounting nut 118 along the nipple body 300, the mounting washer 116 can be pressed firmly against the pre-mounting surface. The mounting washer 116 includes at least one finger 122 and at least one tooth 124, which both extend from a side of the mounting washer 116 intended to face the pre-mounting surface. In one exemplary embodiment, the mounting washer 116 includes a pair of fingers 122 set apart from but otherwise aligned with one another (see FIG. 1A). The fingers 122 fit into the axial grooves 312 formed on the outer sleeve 304 of the nipple body 300 to prevent rotation of the mounting washer 116 relative to the nipple body 300, as the mounting washer 116 surrounds the nipple body 300. In one exemplary embodiment, the mounting washer 116 includes four teeth 124 evenly spaced around a periphery of the mounting washer 116 (see FIG. 1A). The teeth 124 are shaped (e.g., pointed) to dig into the pre-mounting surface when the mounting washer 116 is pressed against the pre-mounting surface. In this manner, the first mounting nut 106, the mounting washer 116 and the second mounting nut 118 secure the nipple body 300 in the hole of the pre-mounting surface and prevent any rotational or axial movement of the nipple body 300 relative to the pre-mounting surface.

Thereafter, once the final thickness of the mounting surface is known, the spout shank 200 can interface with the nipple body 300 to complete the adjustable locking spout shank assembly 100 for mounting the spout on the mounting surface. Before the spout shank 200 is inserted into the nipple body 300, the wedge nut 400 is inserted into the end of the spout shank 200 where the flanges 206 are formed. One of ordinary skill in the art will appreciate that the general inventive concept encompasses all or a portion of the spout shank 200 being inserted into the nipple body 300 and all or a portion of the wedge nut 400 being inserted in the spout shank 200. The wedge nut 400 is inserted so that the cylindrical portion 404 of the wedge nut 400 enters the spout shank 200 first. The wedge nut 400 is inserted until the threads 408 on the cylindrical portion 404 reach the second threaded portion 220 of the spout shank 200. Then, the wedge nut 400 is manipulated so that the threads 408 on the cylindrical portion 404 of the wedge nut 400 interface with the second threaded portion 220 of the spout shank 200 enough to keep the wedge nut 400 from falling out of the spout shank 200.

After the wedge nut 400 is secured in the spout shank 200, the spout shank 200 is slid through the first mounting nut 106 until it enters the nipple body 300. The end of the spout shank 200 where the flanges 206 are formed (and where the wedge nut 400 is secured) enters the nipple body 300 first.

Once the spout shank 200 is slid into the nipple body 300, the clip 500 can be placed around the spout shank 200 and then inserted in the first mounting nut 106. When the clip 500 is placed around the spout shank 200, the two axially extending flat portions 204 of the spout shank 200 are aligned with the two opposing flat sides 502 of the clip 500 (see FIG. 1B). As a result, a curved portion of the spout shank 200 is aligned with the curved side 504 of the clip 500 (see FIG. 1B). Because the clip 500 is prevented from rotating relative to the nipple body 300, as described above, the corresponding interface between the spout shank 200 and the clip 500 also prevents the spout shank 200 from rotating relative to the nipple body 300.

Figure 1B:
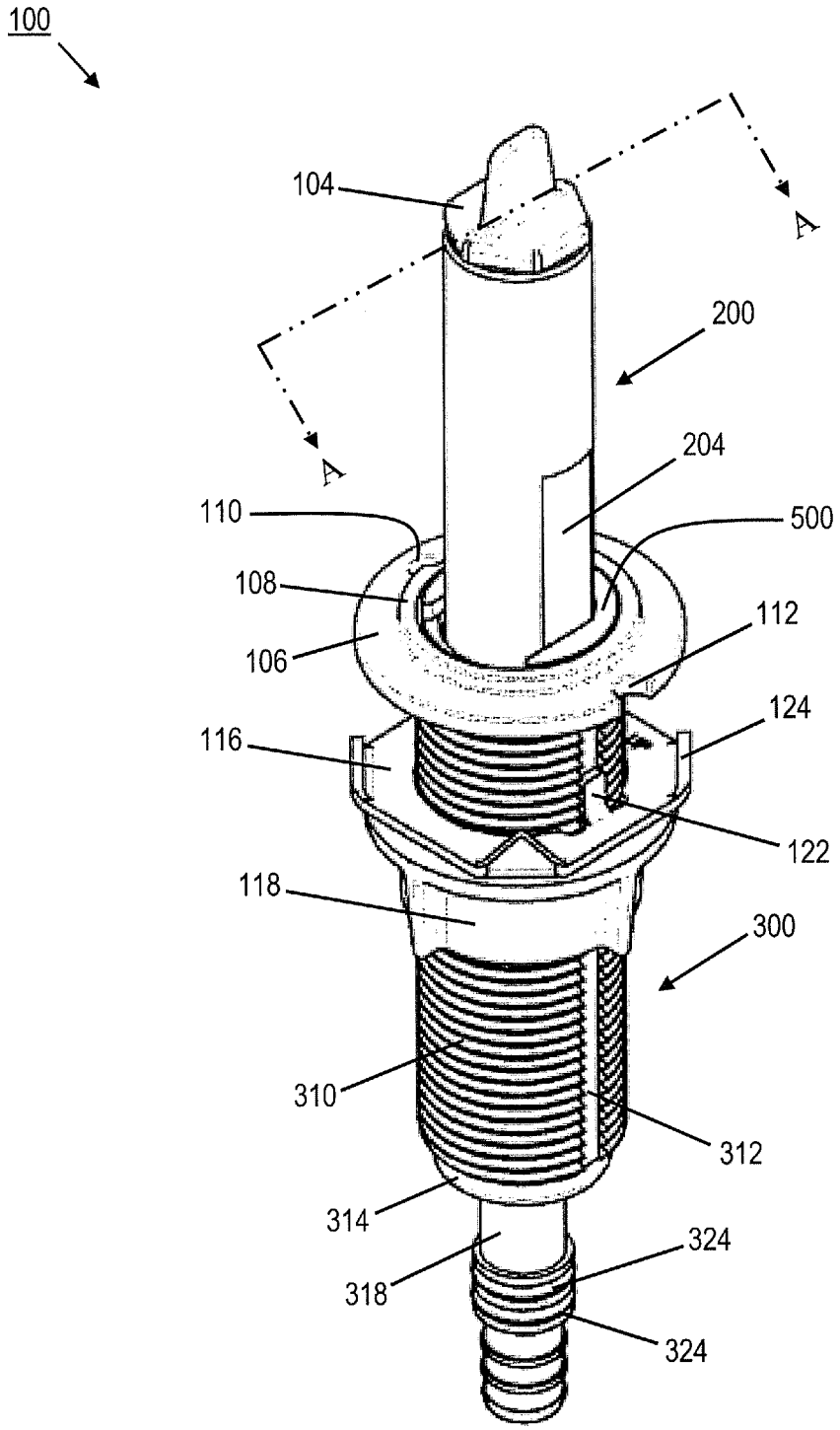
Figure 1C:
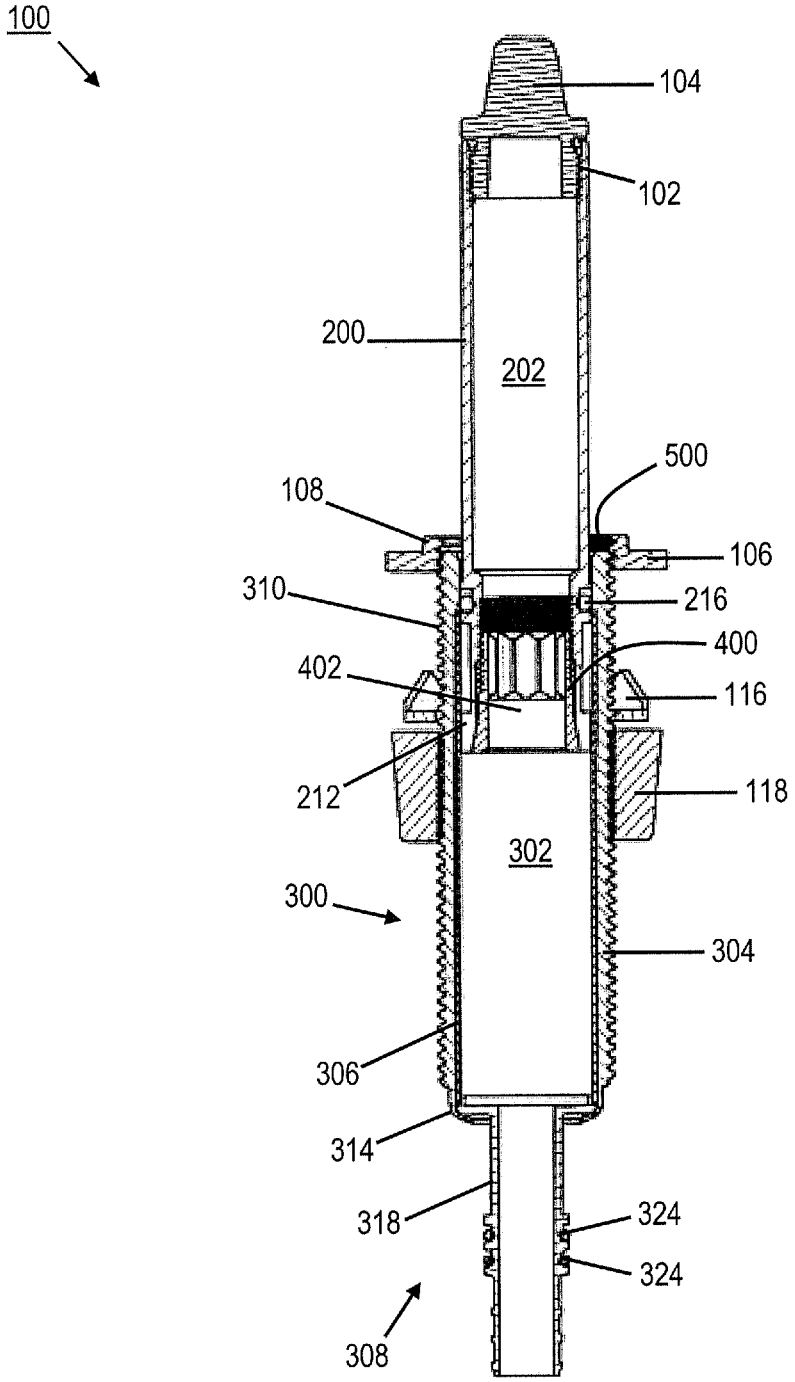

The clip 500 is sized to fit in the circular raised portion 108 of the first mounting nut 106 with the tabs 506 of the clip 500 extending into the notches 316 of the outer sleeve 304 of the nipple body 300 (see FIGS. 1A, 1B and 1C). In this manner, the clip 500 is prevented from rotating relative to the nipple body 300. In one exemplary embodiment in which the clip 500 includes two evenly-spaced tabs 506 and the outer sleeve 304 includes two corresponding evenly-spaced notches 316, the clip 500 can be inserted in the first mounting nut 106 in either of two orientations, wherein the two orientations can be cycled through by rotating the clip 500 one-hundred and eighty (180) degrees about a central axis of the first mounting nut 106. In one exemplary embodiment, the tabs 506 of the clip 500 are sized and/or shaped to interface with the notches 316 of the outer sleeve 304 of the nipple body 300 to resist any axial displacement of the clip 500 relative to the first mounting nut 106. In one exemplary embodiment, the clip 500 is friction fit in the circular raised portion 108 of the first mounting nut 106 to resist any axial displacement of the clip 500 relative to the first mounting nut 106.

Although the clip 500 prevents rotation of the spout shank 200 relative to the nipple body 300, the spout shank 200 is able to move axially through the clip 500 (e.g., within a range defined by the flat portions 204 of the spout shank 200) relative to the nipple body 300. In this manner, the spout shank 200 can be axially displaced relative to the nipple body 300 to vary the effective length of the adjustable locking spout shank assembly 100, thereby achieving a desired installation length for the spout, for example, as necessitated by a thickness of the mounting surface. In one exemplary embodiment, the effective length of the adjustable locking spout shank assembly 100 is defined by a minimum length and a maximum length, wherein the minimum length and the maximum length are separated by approximately 1.5 inches.

Once the spout shank 200 is adjusted to achieve the desired installation length, the spout shank 200 can be locked in place to prevent any further axial movement of the spout shank 200 relative to the nipple body 300. To lock the spout shank 200 relative to the nipple body 300, a tool or other device is inserted through the inner cavity 202 of the spout shank 200 to manipulate the wedge nut 400. In particular, the tool engages the facets 410, the peaks 412 and/or the valleys 414 of the wedge nut 400 to turn the wedge nut 400. In one exemplary embodiment, the tool is a ratchet wrench extension arm. Depending on the direction that the wedge nut 400 is turned, the wedge nut 400 is axially displaced further in to or out of the spout shank 200.

As the wedge nut 400 is axially displaced further in to the spout shank 200 so that more of the sloped portion 406 of the wedge nut 400 contacts the flanges 206 of the spout shank 200, the flanges 206 flex outwardly toward the inner surface of the spout shank 200. As the flanges 206 flex toward the inner surface of the spout shank 200, the second portion 212 of each flange 206 contacts the inner surface of the spout shank 200 to effectively lock the spout shank 200 relative to the nipple body 300, such that axial movement of the spout shank 200 relative to the nipple body 300 is prevented.

Additionally, as the wedge nut 400 is axially displaced further in to the spout shank 200, a portion of the sloped portion 406 of the wedge nut 400 with an increased circumference contacts the flanges 206 of the spout shank 200. Consequently, a greater force is imparted against the flanges 206, which strengthens the lock between the spout shank 200 and the nipple body 300. If the spout shank 200 needs to be readjusted, the tool can be used to axially displace the wedge nut 400 further out of the spout shank 200 so that the sloped portion 406 of the wedge nut 400 contacting the flanges 206 of the spout shank 200 (if any) has a decreased circumference, which reduces the force applied against the flanges 206, thereby allowing the spout shank 200 to be axially displaced relative to the nipple body 300.

After the spout shank 200 is locked relative to the nipple body 300, the adjustable locking spout shank assembly 100 can be connected to a water supply source (not shown). A hose, pipe or other conduit is connected to the tubular nipple 318 of the connector 308. The pair of O-rings 324 disposed in the grooves 322 of the tubular nipple 318 provides a water tight connection between the connector 308 and the hose.

The O-ring 216 disposed in the groove 214 on the outer surface of the spout shank 200 maintains a water tight seal between the spout shank 200 (adjacent to the flanges 206) and the nipple body 300. With the test plug 104 inserted in the spout shank 200, the integrity of the adjustable locking spout shank assembly 100 can be tested by allowing water from the water supply source to flow through the adjustable locking spout shank assembly 100 to insure that no leaks are present.

If no leaks are found, the test plug 104 is removed and the spout is mounted on the adjustable locking spout shank assembly 100. The spout and/or other components (e.g., an escutcheon) cover those portions of the adjustable locking spout shank assembly 100 extending through the mounting surface. One or more fluid control valves (not shown) are disposed between the water supply source and the spout to control the delivery (e.g., flow and/or temperature) of the water through the adjustable locking spout shank assembly 100 (i.e., through the inner cavity 302 of the nipple body 300, the inner cavity 402 of the wedge nut 400 and the inner cavity 202 of the spout shank 200) and out the spout (see FIG. 1C).

In view of the above, the adjustable locking spout shank assembly 100 is able to accommodate mounting the spout on mounting surfaces defining a wide range of installation thicknesses.

The above description of specific embodiments has been given by way of example. From the disclosure given, those skilled in the art will not only understand the general inventive concept and its attendant advantages, but will also find apparent various changes and modifications to the structures and methods disclosed. For example, although the above exemplary embodiments were described in relation to mounting a spout on a mounting surface, the general inventive concept is applicable to mounting other plumbing fixtures, such as a shower head post or tube. It is sought, therefore, to cover all such changes and modifications as fall within the spirit and scope of the general inventive concept, as defined by the appended claims, and equivalents thereof.

The invention claimed is:

1. An apparatus for extending through a mounting surface and operable to interface with a water delivery fixture at a first end and a water supply source at a second end, the apparatus comprising:

a first generally tubular body for interfacing with the water delivery fixture;

a second generally tubular body for interfacing with the water supply source; and a nut, wherein a portion of the nut fits in the first tubular body;

wherein a portion of the first tubular body fits in the second tubular body;

wherein axial displacement of the first tubular body relative to the second tubular body is operable to vary a length of the apparatus;

wherein an end of the first tubular body includes a plurality of flanges;

wherein the flanges are enclosed by the second tubular body if the portion of the first tubular body is placed in the second tubular body; and wherein axial displacement of the nut relative to the first tubular body in a first direction causes the flanges to flex outwardly toward an inner surface of the second tubular body to resist axial displacement of the first tubular body relative to the second tubular body.

2. The apparatus of claim 1, wherein placement of the portion of the nut in the first tubular body and placement of the portion of the first tubular body in the second tubular body defines a conduit through which a fluid can flow from the second end of the apparatus to the first end of the apparatus.

3. The apparatus of claim 1, wherein each adjacent pair of the flanges is separated by an axial gap.

4. The apparatus of claim 1, wherein each of the flanges includes a first portion having a first thickness and a second portion having a second thickness; and wherein the first thickness is less than the second thickness.

5. The apparatus of claim 1, wherein the nut includes a cylindrical portion and a sloped portion;

wherein a circumference of the sloped portion increases as its distance from the cylindrical portion increases; and wherein the sloped portion has a predetermined slope relative to the cylindrical portion.

6. The apparatus of claim 5, wherein the predetermined slope is approximately 11 degrees.

7. The apparatus of claim 5, wherein an inner surface of a portion of the cylindrical portion of the nut is textured so that the nut is operable to interface with a tool to facilitate rotation of the nut within the first tubular body.

8. The apparatus of claim 5, wherein first threads are formed on an outer surface of the cylindrical portion of the nut;

wherein second threads are formed on an inner surface of the first tubular body adjacent to the flanges;

wherein the first threads and the second threads interface such that a clockwise rotation of the nut is operable to cause axial displacement of the nut relative to the first tubular body in a first direction; and wherein the first threads and the second threads interface such that a counterclockwise rotation of the nut is operable to cause axial displacement of the nut relative to the first tubular body in a second direction.

9. The apparatus of claim 8, wherein each adjacent pair of the flanges is separated by an axial gap.

10. The apparatus of claim 8, wherein each of the flanges includes a first portion having a first thickness and a second portion having a second thickness; and wherein the first thickness is less than the second thickness.

11. A system for mounting a water delivery fixture on a mounting surface, the system comprising:

a first generally tubular body;

a second generally tubular body;

a nut; and a clip, wherein a portion of the nut fits in the first tubular body;

wherein a portion of the first tubular body fits in the second tubular body to form an apparatus for extending through the mounting surface;

wherein the clip is operable to interface with the first tubular body and the second tubular body to prevent rotation of the first tubular body relative to the second tubular body and allow axial displacement of the first tubular body relative to the second tubular body;

wherein axial displacement of the first tubular body relative to the second tubular body is operable to vary a length of the apparatus;

wherein an end of the first tubular body includes a plurality of flanges;

wherein the flanges are enclosed by the second tubular body if the portion of the first tubular body is placed in the second tubular-body; and wherein axial displacement of the nut relative to the first tubular body in a first direction causes the flanges to flex outwardly toward an inner surface of the second tubular body to resist axial displacement of the first tubular body relative to the second tubular body.

12. The system of claim 11, further comprising:

a first mounting nut; and a second mounting nut, wherein the first mounting nut is operable to interface with the second tubular body on a first side of the mounting surface;

wherein the second mounting nut is operable to interface with the second tubular body on a second side of the mounting surface; and wherein the first mounting nut and the second mounting nut are operable to prevent axial displacement of the second tubular body relative to the mounting surface.

13. The system of claim 12, wherein the first mounting nut includes a recess; and wherein the clip fits in the recess.

14. The system of claim 11, wherein the clip includes a tab; and wherein the tab fits in a corresponding notch formed in the second tubular body to prevent rotation of the clip relative to the second tubular body.

15. The system of claim 14, wherein the clip includes a curved side and a flat side;

wherein the curved side of the clip interfaces with a curved portion of the first tubular body; and wherein the flat side of the clip interfaces with a flat portion of the first tubular body.

16. The system of claim 12, further comprising a mounting washer, wherein the mounting washer fits around the second tubular body; and wherein the mounting washer is adapted to be disposed between the second mounting nut and the second side of the mounting surface, such that the mounting washer is operable to interface with the second tubular body and the second side of the mounting surface to prevent rotation of the second tubular body relative to the mounting surface.

17. The system of claim 16, wherein the mounting washer includes a finger and a tooth;

wherein the finger is operable to interface with a recess on an outer surface of the second tubular body; and wherein the tooth is operable to press against the second side of the mounting surface.

18. The system of claim 12, wherein the first mounting nut includes structure to facilitate mounting of the water delivery fixture on the mounting surface; and wherein the second tubular body includes a connector that is operable to connect to a water supply source.

* * * * *